US007158086B2

(12) United States Patent
Inatsugu et al.

(10) Patent No.: US 7,158,086 B2
(45) Date of Patent: Jan. 2, 2007

(54) MONOPOLE ANTENNA

(75) Inventors: Susumu Inatsugu, Hirakata (JP); Takeshi Masutani, Moriguchi (JP); Kazuhiko Fujikawa, Kyotanabe (JP); Masami Segawa, Izumi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/069,985

(22) Filed: Mar. 3, 2005

(65) Prior Publication Data

US 2005/0195111 A1 Sep. 8, 2005

(30) Foreign Application Priority Data

Mar. 4, 2004 (JP) ..... 2004-060364
May 18, 2004 (JP) ..... 2004-147428

(51) Int. Cl.
*H01Q 1/38* (2006.01)

(52) U.S. Cl. ..... 343/711; 343/700 MS

(58) Field of Classification Search ..... 343/711
See application file for complete search history.

(56) References Cited

U.S. PATENT DOCUMENTS 4,191,959 A * 3/1980 Kerr ..... 343/700 MS
4,821,040 A * 4/1989 Johnson et al. ..... 343/700 MS
5,061,939 A * 10/1991 Nakase ..... 343/700 MS
5,291,210 A * 3/1994 Nakase ..... 343/700 MS
6,188,366 B1 * 2/2001 Yamamoto et al. ..... 343/722
6,906,677 B1 * 6/2005 Yamamoto et al. ..... 343/789

FOREIGN PATENT DOCUMENTS

| | | |
|---|---|---|
| EP | 0 963 004 | 12/1999 |
| EP | 1 198 028 | 4/2002 |
| EP | 1 445 828 | 8/2004 |
| GB | 1 546 571 | 5/1979 |
| JP | 2000-059129 | 2/2000 |

* cited by examiner

*Primary Examiner*—Don Wong
*Assistant Examiner*—Binh Van Ho
(74) *Attorney, Agent, or Firm*—Wenderoth, Lind & Ponack, L.L.P.

(57) ABSTRACT

A monopole antenna is formed of a ground plane, a flat conductor faced to the ground plane and separated from it by a clearance "H", and a linear conductor that is connected to the flat conductor, extended on the ground plane side in an insulated state from the ground plane, and connected to a signal source. The flat conductor is formed of an inner conductor, and outer conductors disposed on the outer periphery of the inner conductor at a predetermined interval. Set regions of the outer edge of the inner conductor and the inner edges of the outer conductors are interconnected through one or more coupling conductors.

6 Claims, 7 Drawing Sheets

A1=H+D

MONOPOLE ANTENNA

FIELD OF THE INVENTION

The present invention relates to an on-vehicle antenna for use in mobile communications by an automobile or the like, or more specifically to a multi-band monopole antenna that operates in a plurality of frequency bands.

BACKGROUND OF THE INVENTION

Recently, services such as a car telephone, the Internet connection of navigation, an information service, and an emergency reporting system have been commercialized in a mobile such as an automobile.

The frequency bands used for the car telephone are a 0.8 GHz band and a 1.5 GHz or 2 GHz band in Japan, and a 0.8 GHz band and a 1.9 GHz or 2 GHz band in other countries, for example.

For providing these services, an on-vehicle antenna that operates in a plurality of frequency bands in these systems is increasingly required.

The configuration and operation of a conventional monopole antenna that can support three operating frequencies are described with reference to FIG. 8, FIG. 9A and FIG. 9B.

FIG. 8 is a schematic perspective view of the conventional monopole antenna. FIG. 9A and FIG. 9B are characteristic diagrams of the monopole antenna. The monopole antenna 800 includes antenna element 5400 and feeding point 5200 for supplying high-frequency signals to flat conductor 6000 of antenna element 5400.

Antenna element 5400 has flat conductor 6000, resonance circuits 7100 and 7200, linear conductor 5300 of which one end is connected to inner conductor 6100, and. ground plane 5100. Flat conductor 6000 is made of conductive material such as copper, and has inner conductor 6100, first outer conductor 6200, and second outer conductor 6300. Conductors 6100, 6200 and 6300 are formed concentrically from the inside on the same plane. Second outer conductor 6300 has the longest outer diameter D. In flat conductor 6000, the outer edge of inner conductor 6100 is connected to the inner edge of first outer conductor 6200 via resonance circuit 7100, and the outer edge of first outer conductor 6200 is connected to the inner edge of second outer conductor 6300 via resonance circuit 7200.

Resonance circuits 7100 and 7200 are formed so as to provide a resonance frequency set by a parallel circuit of a coil and a capacitor, for example. At this set resonance frequency, the impedance is high. Therefore, in resonance circuit 7100, for example, inner conductor 6100 is insulated from first outer conductor 6200. The impedance is low at a frequency other than the set resonance frequency, so that inner conductor 6100 is substantially electrically connected to first outer conductor 6200. The same is true of resonance circuit 7200.

The other end of linear conductor 5300 connected to flat conductor 6000 of antenna element 5400 penetrates ground plane 5100 and is connected to feeding point 5200. High-frequency signals from a signal source (not shown) are fed to flat conductor 6000 via feeding point 5200 and linear conductor 5300.

In monopole antenna 800 having such a configuration, when highest first frequency f1, intermediate second frequency f2, and lowest third frequency f3 are fed from the signal source to antenna element 5400 via feeding point 5200, antenna element 5400 operates as follows.

Firstly, when first frequency f1 is fed, resonance circuit 7100 has high impedance at first frequency f1 because resonance circuit 7100 is set to resonate with first frequency f1. As a result, inner conductor 6100 is electrically insulated from first outer conductor 6200, and only linear conductor 5300 and inner conductor 6100 resonate.

Next, when second frequency f2 lower than first frequency f1 is fed, resonance circuit 7100 has low impedance. Therefore, inner conductor 6100 is substantially electrically connected to first outer conductor 6200, and second frequency f2 is transmitted to first outer conductor 6200. While, resonance circuit 7200 has high impedance at second frequency f2 because resonance circuit 7200 is set to resonate with second frequency f2. First outer conductor 6200 is, therefore, electrically insulated from second outer conductor 6300. At second frequency f2, not only linear conductor 5300 and inner conductor 6100, but also first outer conductor 6200 resonates.

Next, when third frequency f3 lower than second frequency f2 is fed, resonance circuit 7200 also has low impedance, and first outer conductor 6200 is substantially electrically connected to second outer conductor 6300. As a result, third frequency f3 is transmitted to second outer conductor 6300, and not only linear conductor 5300, inner conductor 6100, and first outer conductor 6200, but also outer conductor 6300 resonates.

Monopole antenna 800 can thus operate at three frequencies. Directivity, namely one of characteristics of monopole antenna 800 is shown in FIG. 9A and FIG. 9B. FIG. 9A and FIG. 9B show characteristics obtained when XYZ orthogonal coordinate system is set using the center of ground plane 5100 as the origin as shown in FIG. 8. FIG. 9A shows the characteristic in the XY coordinates, and FIG. 9B shows the characteristic in the XZ coordinates.

In a typical monopole antenna, the directivity has a circular shape (hereinafter called omni direction) in the XY coordinates and a figure eight shape having right and left shapes that are substantially the same in the XZ coordinates. In the XY coordinates, the radio wave can be transmitted or received longitudinally and laterally in any direction. The figure eight shaped directivity in the XZ coordinates means that dented ellipse is substantially symmetric with respect to the axial line of the Z-axis and the radio wave can be transmitted or received especially in the X-axis direction.

In monopole antenna 800 shown in FIG. 8, the directivities at both second frequency f2 and third frequency f3 have a circular shape in the XY coordinates as shown in FIG. 9A, indicating omni direction. When second frequency f2 and third frequency f3 lie in the 1.9 GHz band on the high frequency side and the 0.9 GHz band on the low frequency side for a car telephone, respectively, for example, the directivity has a circular shape, namely the omni direction, at either frequency.

As shown in FIG. 9B, it is difficult that the directivities at both second frequency f2 and third frequency f3 have a figure eight shape in monopole antenna 800. In FIG. 9B, the directivity at third frequency f3 has a figure eight shape, but the directivity at second frequency f2 has no figure eight shape. The difference between the directivities at second frequency f2 and third frequency f3 in the XZ coordinates in FIG. 9B causes a difference between intensities (hereinafter called radio emission intensities) of the directivities in the XY coordinates in FIG. 9A. In other words, since the directivity at third frequency f3 has the figure eight shape and the directivity at second frequency f2 has no figure eight shape, circles indicating the radio emission intensities at second frequency f2 and third frequency f3 have a different diameter in FIG. 9A. In monopole antenna 800, the radio emission intensity at second frequency f2 is about 3 dBi lower than that at third frequency f3.

A configuration similar to that of conventional monopole antenna 800 is disclosed in Japanese Patent Unexamined Publication No. 2000-059129.

The radio emission intensities at two operating frequencies, namely second frequency f2 and third frequency f3 in the example discussed above, are different from each other in conventional monopole antenna 800. Therefore, when two operating frequencies are required due to a difference in communication company and communication method in a system such as a car telephone, the following problem arises. In other words, required radio emission intensity can be secured and transmitting/receiving sensitivity is high at one frequency, but required radio emission intensity cannot be sufficiently secured and transmitting/receiving sensitivity is low at the other frequency.

The present invention addresses the conventional problem, and provides a monopole antenna that can operate at a plurality of frequencies and can secure required radio emission intensity at any operating frequency.

SUMMARY OF THE INVENTION

A monopole antenna of the present invention has the following elements:

- a ground plane;
- a flat conductor faced to the ground plane and separated from it by a predetermined clearance;
- a linear conductor that is coupled to the flat conductor, insulated from the ground plane, extended on the ground plane side, and coupled to a signal source; and
- the flat conductor is formed of an inner conductor and an outer conductor that is disposed around the inner conductor and separated from it by a predetermined clearance, and predetermined region of the clearance between the outer edge of the inner conductor and the inner edge of the outer conductor is interconnected through one or more coupling conductors.

Since the inner conductor is connected to the outer conductor through the coupling conductors in such a configuration, the inner conductor and the outer conductor can be operated at different frequencies. Required radio emission intensity can be secured at any operating frequency.

In such a configuration, the coupling conductors may be disposed at positions symmetric with respect to the center of the flat conductor. This configuration can also secure required radio emission intensities at a plurality of operating frequencies.

The flat conductor may be formed by integrating an inner conductor, an outer conductor, and coupling conductors. This configuration allows easy manufacturing of the flat conductor formed by integrating the inner conductor, the outer conductor, and the coupling conductors.

A short-circuit conductor may be disposed in parallel with the linear conductor, and the ground plane and the inner conductor may be short-circuited through the short circuit conductor. In this configuration, the short-circuit conductor and the linear conductor can be resonated in the same phase, so that the impedance of the monopole antenna can be increased and the resonance frequency band can be enlarged.

A configuration may be employed where the ground plane is disposed on one surface of a dielectric material, a flat conductor is disposed on the other surface, and the linear conductor connected to the flat conductor is insulated from the ground plane, extended on the ground plane side, and connected to the signal source. In this configuration, when the dielectric material has a dielectric constant larger than that of the air, the clearance between the ground plane and the flat conductor can be decreased. Additionally, the ground plane and the flat conductor can be integrated by the dielectric material, and the manufacturing of the monopole antenna can be simplified.

In the configuration, the outer size of the ground plane may be larger than that of the flat conductor, and may be smaller than the wavelength of the highest frequency of a plurality of operating frequencies. This configuration allows the ground plane to be set at a predetermined size, so that the ground plane can be installed on either of the inside and outside of a vehicle.

The present invention can provide a monopole antenna that operates at a plurality of frequencies and can secure required radio emission intensity at any operating frequency, and the monopole antenna is useful in a mobile communication field of the vehicle or the like.

DETAILED DESCRIPTION OF THE INVENTION

Figure 1:
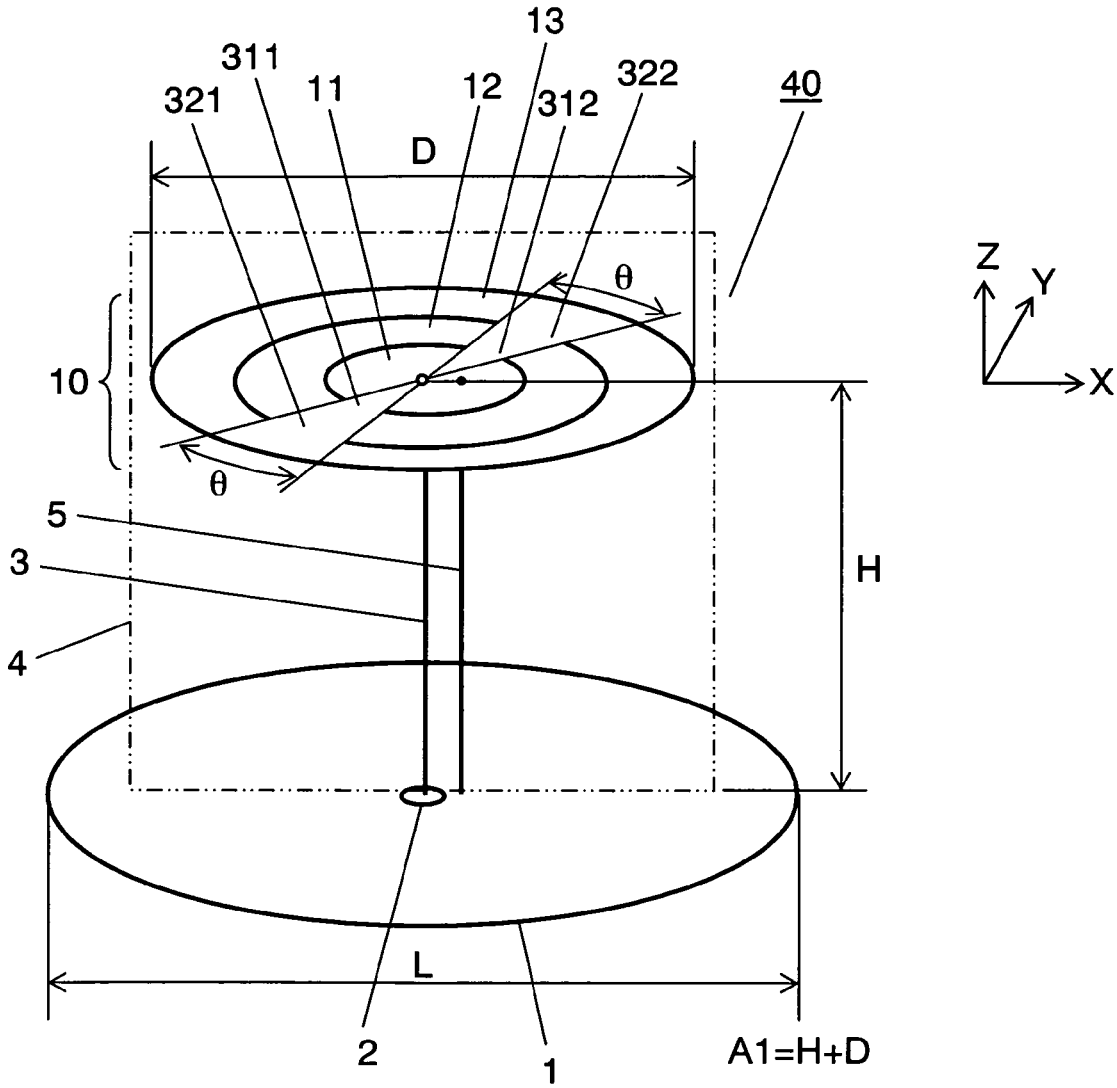
FIG. 1 is a schematic perspective view of a monopole antenna in accordance with a first exemplary embodiment of the present invention.

A monopole antenna in accordance with an exemplary embodiment of the present invention will be described hereinafter with reference to the drawings. Same elements are denoted with the same reference numbers in the drawings, and the descriptions of those elements are omitted.

Figure 2A:
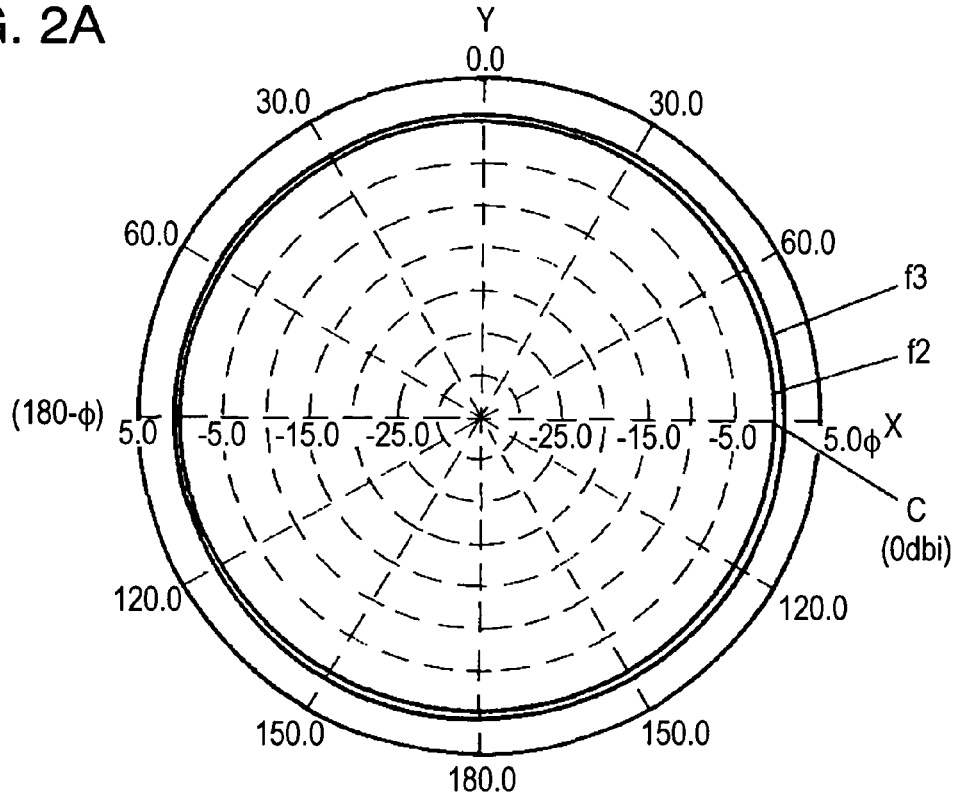
FIG. 2A and FIG. 2B are characteristic diagrams of the monopole antenna in accordance with the exemplary embodiment.
Figure 2B:
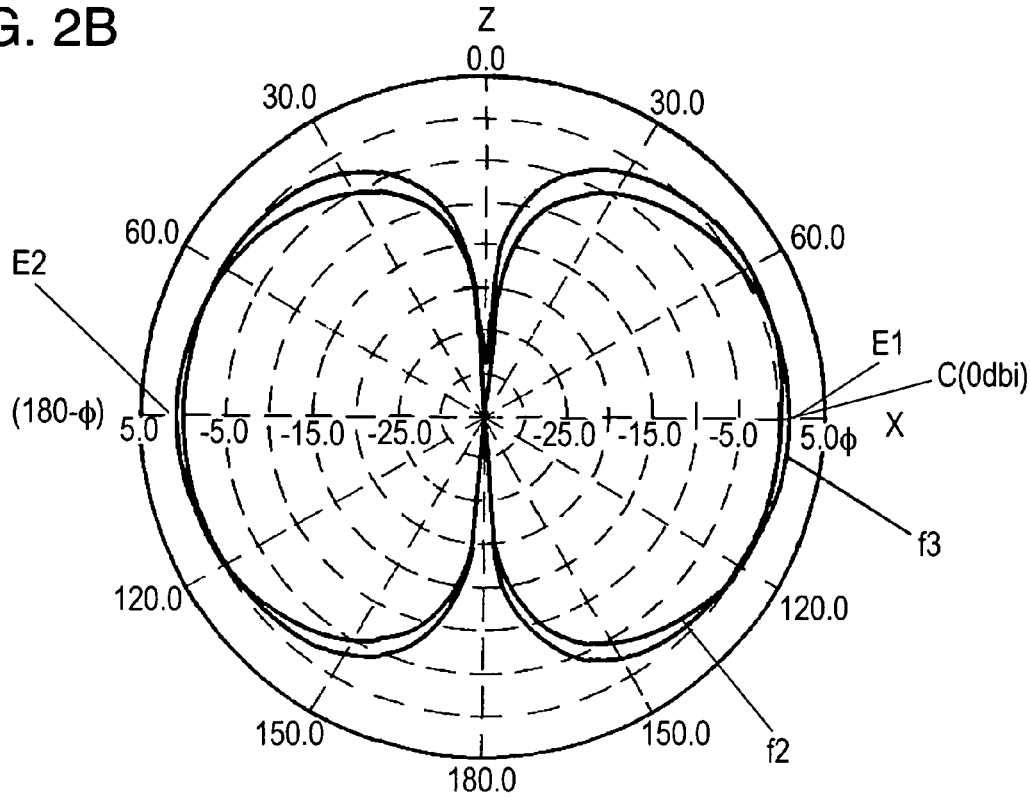

FIG. 1 is a schematic perspective view of monopole antenna 40 in accordance with a first exemplary embodiment of the present invention. FIG. 2A and FIG. 2B are characteristic diagrams of monopole antenna 40 of the exemplary embodiment. Monopole antenna 40 is formed of antenna element 4 and ground plane 1. Antenna element 4 has flat conductor 10, linear conductor 3, and short-circuit conductor 5. Flat conductor 10 can be formed of a single copper plate or a copper foil for a wiring board. Ground plane 1 is preferably made of conductive material such as copper.

Flat conductor 10 is faced to ground plane 1 and separated from it by clearance H. Flat conductor 10 is formed of inner conductor 11, first outer conductor 12, and second outer conductor 13. Conductors 11, 12 and 13 are disposed concentrically on the same plane in this order from the inside. Second outer conductor 13 has a maximum outer diameter D.

As shown in FIG. 1, the outer edge of inner conductor 11 is connected to the inner edge of first outer conductor 12 through two coupling conductors 311 and 312 having set angle "θ". The outer edge of first outer conductor 12 is connected to the inner edge of second outer conductor 13 through two coupling conductors 321 and 322 having the same angle "θ". Therefore, inner conductor 11, first outer conductor 12, and second outer conductor 13 are integrated by coupling conductors 311, 312, 321 and 322.

Coupling conductors 311 and 312 for connecting inner conductor 11 to first outer conductor 12 and coupling conductors 321 and 322 for connecting first outer conductor 12 to second outer conductor 13 are disposed symmetrically with respect to the center of flat conductor 10. This center substantially matches with the center of ground plane 1. Diameter L as the outer size of ground plane 1 is set longer than diameter D of flat conductor 10 and shorter than the wavelength of the highest frequency (the operating frequency of inner conductor 11) of a plurality of operating frequencies.

Rod-like linear conductor 3 made of metal such as copper and rod-like short-circuit conductor 5 made of metal are disposed in parallel with each other, and are connected to a substantially central part of inner conductor 11. Here, linear conductor 3 is extended from feeding point 2 insulated from ground plane 1, and short-circuit conductor 5 is connected to ground plane 1.

In monopole antenna 40 of the exemplary embodiment having this configuration, coupling conductors 311, 312, 321 and 322, inner conductor 11, first outer conductor 12, and second outer conductor 13 are disposed in antenna element 4, and operate similarly to a resonance circuit of a conventional monopole antenna. When highest first frequency f1, intermediate second frequency f2, and lowest third frequency f3 are fed from feeding point 2 to antenna element 4 via linear conductor 3, antenna element 4 operates as follows.

Firstly, when first frequency f1 is fed, coupling conductors 311, 312 have high impedance at first frequency f1 because they are set to resonate with first frequency f1. As a result, inner conductor 11 is electrically insulated from first outer conductor 12. Only linear conductor 3, short-circuit conductor 5, and inner conductor 11 therefore resonate.

Next, when second frequency f2 lower than first frequency f1 is fed, coupling conductors 311 and 312 have low impedance. Therefore, inner conductor 11 is substantially electrically connected to first outer conductor 12. Second frequency f2 is therefore transmitted to first outer conductor 12. When second frequency f2 is fed, coupling conductors 321 and 322 have high impedance at second frequency f2 because they are set to resonate with second frequency f2. Therefore, first outer conductor 12 is electrically insulated from second outer conductor 13. At second frequency f2, in addition to linear conductor 3, short-circuit conductor 5, and inner conductor 11, first outer conductor 12 resonates.

Next, when third frequency f3 lower than second frequency f2 is fed, not only coupling conductors 311 and 312, but also coupling conductors 321 and 322 have low impedance. Therefore, first outer conductor 12 is substantially electrically connected to second outer conductor 13. Third frequency f3 is therefore transmitted to second outer conductor 13. In this case, in addition to linear conductor 3, short-circuit conductor 5, inner conductor 11, and first outer conductor 12, second outer conductor 13 resonates.

Short-circuit conductor 5 and linear conductor 3 resonate in the same phase in this case.

The reason why each coupling conductor has impedance depending on a predetermined frequency is considered as follows. The reason why coupling conductors 311 and 312 resonating with first frequency f1 have high impedance at first frequency f1 is described as an example.

Coupling conductors 311 and 312 connect inner conductor 11 to first outer conductor 12, and operate as coil L at high frequency. In two facing regions that do not include coupling conductor 311 or 312 in inner conductor 11 and first outer conductor 12, the clearance between inner conductor 11 and first outer conductor 12 operates as capacitor C. As a result, coil L and capacitor C are interconnected in parallel to form a resonance circuit. In this example, the resonance circuit has high impedance at first frequency f1.

The directivity as a characteristic of monopole antenna 40 that operates at three frequencies is as follows. When XYZ orthogonal coordinate system is set using the center of ground plane 1 as the origin as shown in FIG. 1, FIG. 2A shows the characteristic in the XY coordinates, and FIG. 2B shows the characteristic in the XZ coordinates.

Second frequency f2 and third frequency f3 are assumed to be in the 1.9 GHz band and the 0.9 GHz band, respectively. The directivity in the XY coordinates of FIG. 2A has the omni direction at any frequency when coupling conductors 311, 312, 321 and 322 are used as shown in FIG. 1. In the XY coordinates, the radio wave can be therefore transmitted or received longitudinally and laterally in any direction.

The directivities at second frequency f2 and third frequency f3 in the XZ coordinates of FIG. 2B have a figure eight shape. The figure eight shaped directivity means that the dented ellipse is symmetric with respect to the Z-axis as shown in FIG. 2B. The difference between the directivities at second frequency f2 and third frequency f3 in the XZ coordinates is small in FIG. 2B, so that a difference between radio emission intensities is small in the XY coordinates in FIG. 2A. In other words, circles indicating radio emission intensities at second frequency f2 and third frequency f3 have substantially the same size in FIG. 2A. Sizes of both circles indicate radio emission intensities not lower than 0 dBi (c point). Therefore, required radio emission intensities can be secured at two frequencies.

Figure 3:
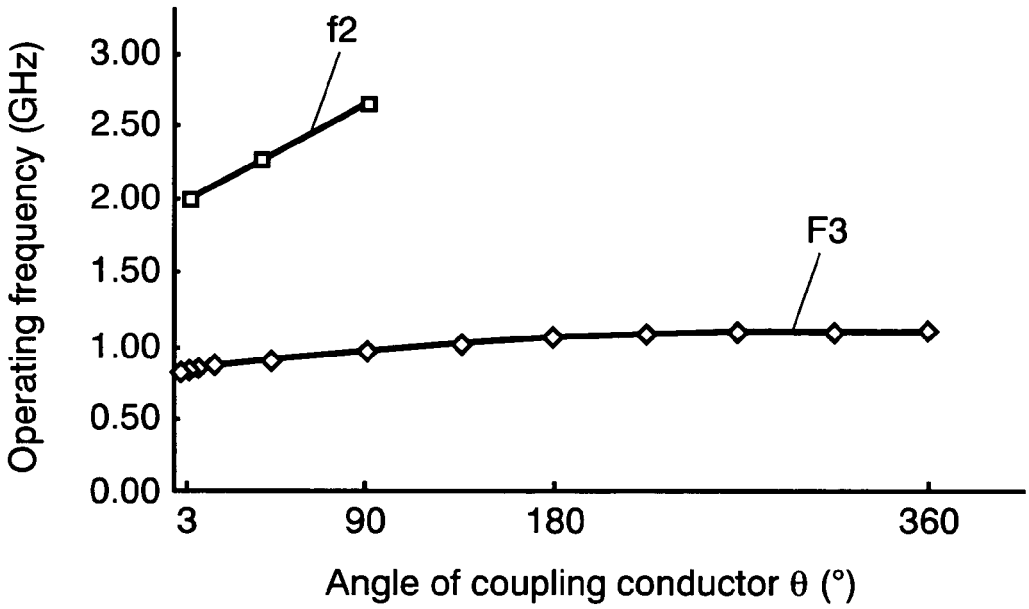
FIG. 3 shows a relation between angle θ of a coupling conductor and operating frequency in the monopole antenna in accordance with the exemplary embodiment.

FIG. 3 shows a relation between angle "θ" of coupling conductors 311, 312, 321 and 322 and operating frequency. The relation between angle "θ" of coupling conductors 321 and 322 for connecting first outer conductor 12 to second outer conductor 13 and second and third frequencies f2 and f3 is described hereinafter as an example.

When angle "θ" of coupling conductors 321 and 322 is 360°, namely first outer conductor 12 and second outer conductor 13 are formed as one outer conductor, the number of operating frequencies is one obviously.

As angle "θ" is decreased from 360°, the number of operating frequencies becomes two at 90°. In other words, first outer conductor 12 operates at second frequency f2, and second outer conductor 13 operates at third frequency f3.

When angle "θ" is further decreased from 90° and angle "θ" is set at about 3° for example, second frequency f2 can be set at 1.9 GHz and third frequency f3 can be set at 0.9 GHz. These frequencies match with frequencies on the high frequency side and low frequency side for a car telephone, so that the antenna can be used for the car telephone.

Angle "θ" of coupling conductors 311 and 312 for connecting inner conductor 11 to first outer conductor 12 may be set the same as angle "θ" of coupling conductors 321 and 322. However, these angles do not need to be the same. When angle "θ" of coupling conductors 311 and 312 is selected appropriately, inner conductor 11 can be operated at first frequency f1 higher than second frequency f2. When angle "θ" of coupling conductors 311 and 312 and angle "θ" of coupling conductors 321 and 322 are appropriately selected, the desired resonance frequency can be obtained. As a result, even when the number of operating frequencies increases to three or more, the frequencies can be supported and a resonance circuit formed of a parallel circuit of a coil and a capacitor is not required. Here, the resonance circuit is required conventionally.

Coupling conductors 311 and 312 for connecting inner conductor 11 to first outer conductor 12 and coupling conductors 321 and 322 for connecting first outer conductor 12 to second outer conductor 13 are formed symmetrically with respect to a substantially central part of flat conductor 10 in the above discussion. However, the present invention is not limited to this. The number of coupling conductors may be set at three or more. When three coupling conductors are employed, for example, they are preferably disposed at an equal angle, every 120°, around the center of flat conductor 10.

Figure 4A:
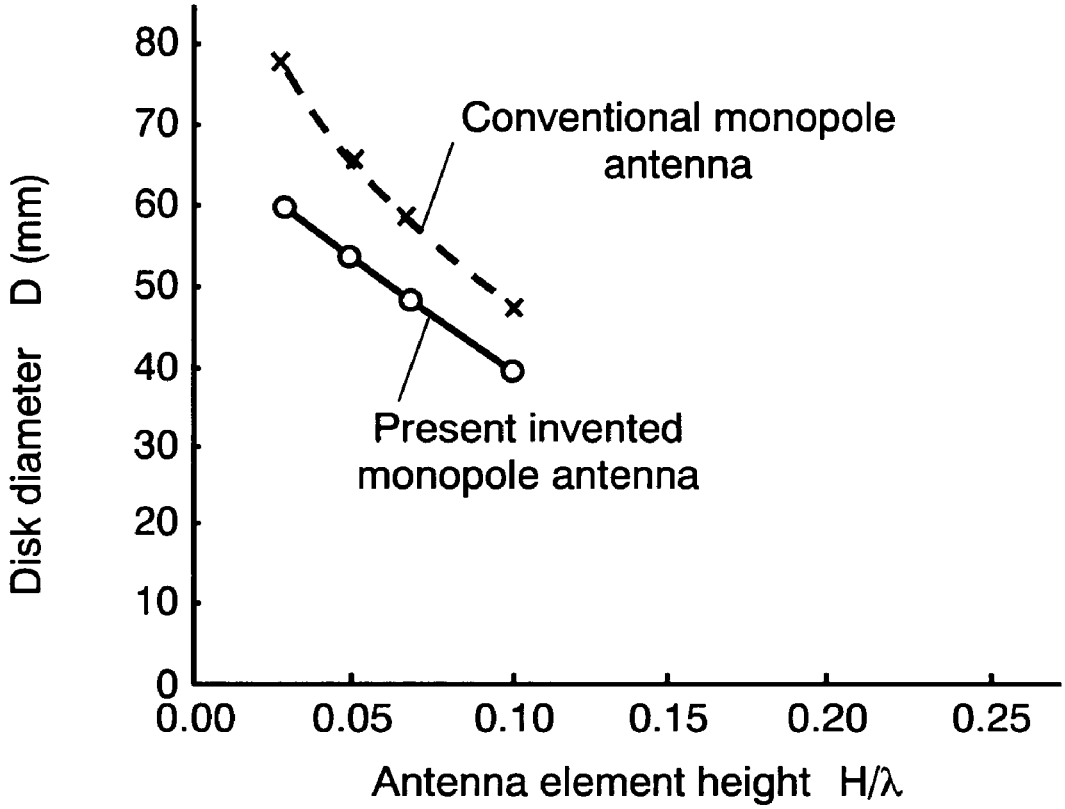
FIG. 4A shows a relation between outer diameter D of a flat conductor and clearance H (height of an antenna element) between the flat conductor and a ground plane in the monopole antenna having a basic configuration shown in FIG. 4B.
Figure 4B:
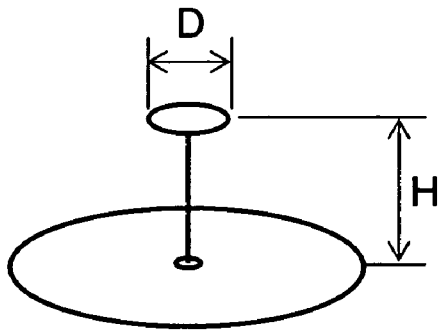
FIG. 4B shows the basic configuration of the monopole antenna in accordance with the exemplary embodiment.

Next, a relation between operating frequencies and the outer size of monopole antenna 40 of the present invention is described with reference to FIG. 4A and FIG. 4B. FIG. 4A shows a relation between outer diameter "D" of the flat conductor and clearance H (height of the antenna element) between the flat conductor and the ground plane in the monopole antenna having a basic configuration shown in FIG. 4B. The vertical axis shows outer diameter "D" of the flat conductor. The horizontal axis shows clearance "H" normalized by wavelength "λ" of operating frequency, namely "H/λ".

The outer size of the conventional monopole antenna is formed so that the monopole antenna excites at ¼ wavelength of the lowest operating frequency. In conventional monopole antenna 800, for example, the sum of clearance "H" between the flat conductor and the ground plane and maximum outer diameter "D" of second outer conductor 6300 is assumed to be set length "A1". Here, clearance "H" indicates the height of linear conductor 5300. At this time, set length "A1" is expressed by A1=H+D. Set length "A1" is set to match with ¼ wavelength of third frequency f3.

When third frequency f3 is 0.9 GHz, for example, set length "A1" is derived as follows from FIG. 4A. In FIG. 4A, the broken line shows data for conventional monopole antenna 800. When the point on the broken line data that corresponds to H/λ=0.10 on the horizontal axis is referred to, maximum outer diameter "D" of second outer conductor 6300 is 50 mm on the vertical axis. Since third frequency f3 is 0.9 GHz, wavelength λ is about 333 mm. Therefore, clearance "H" is expressed by H=0.1×333=33.3 mm. Set length "A1" can be thus derived, and must be about 83 mm because A1=H+D=33.3+50=83.3 mm.

In monopole antenna 40 of the present invention, set length "A1" is derived as follows from FIG. 4A. In FIG. 4A, the solid line shows data for monopole antenna 40. When the point on the solid line data that corresponds to H/λ=0.10 on the horizontal axis is referred to, maximum outer diameter "D" of second outer conductor 13 is 39 mm on the vertical axis. Assuming third frequency f3 to be 0.9 GHz similarly, wavelength "λ" is about 333 mm. Therefore, clearance H is 33.3 mm similarly to that in conventional monopole antenna 800. Set length "A1" can be thus derived as A1=H+D=33.3+39=72.3 mm, and can be set about 11 mm shorter than that of conventional monopole antenna 800.

In other words, set length "A1" of monopole antenna 40 of the present invention can be set not longer than ¼ wavelength of the operating frequency, by disposing coupling conductors 311, 312, 321 and 322. Differently from conventional monopole antenna 800 having resonance circuits 7100 and 7200, in monopole antenna 40, coupling conductors 321 and 322 for connecting first outer conductor 12 to second outer conductor 13 contribute to resonance at second frequency f2 and third frequency f3. Set length "A1" can be decreased by the value corresponding to this contribution.

Set length determined by coupling conductors 311 and 312 for connecting inner conductor 11 to first outer conductor 12 may be also set not longer than ¼ wavelength of second frequency f2.

The directivity determined in the following case is described hereinafter. In other words, diameter "L" of ground plane 1 of FIG. 1 is set larger than the outer size of flat conductor 10 and smaller than the wavelength (λ=150 mm) of the 2 GHz band of the highest frequency f1. Here, the outer size of flat conductor 10 equals to diameter "D" of second outer conductor 13.

For noticeably showing difference between directivities, set length "A1" of the antenna determined when diameter "D" of second outer conductor 13 is set at 56 mm and clearance "H" is set at 13 mm is described.

For example, diameter "L" of ground plane 1 is assumed to be 300 mm, namely longer than the wavelength of the 2 GHz band of highest operating frequency f1. Directivities at second frequency f2 and third frequency f3 in the XZ coordinates shown in FIG. 2B change from a vertically symmetric shape about the X-axis to a vertically asymmetric shape similar to that at second frequency f2 shown in FIG. 9B that shows the conventional antenna.

Figure 9A:
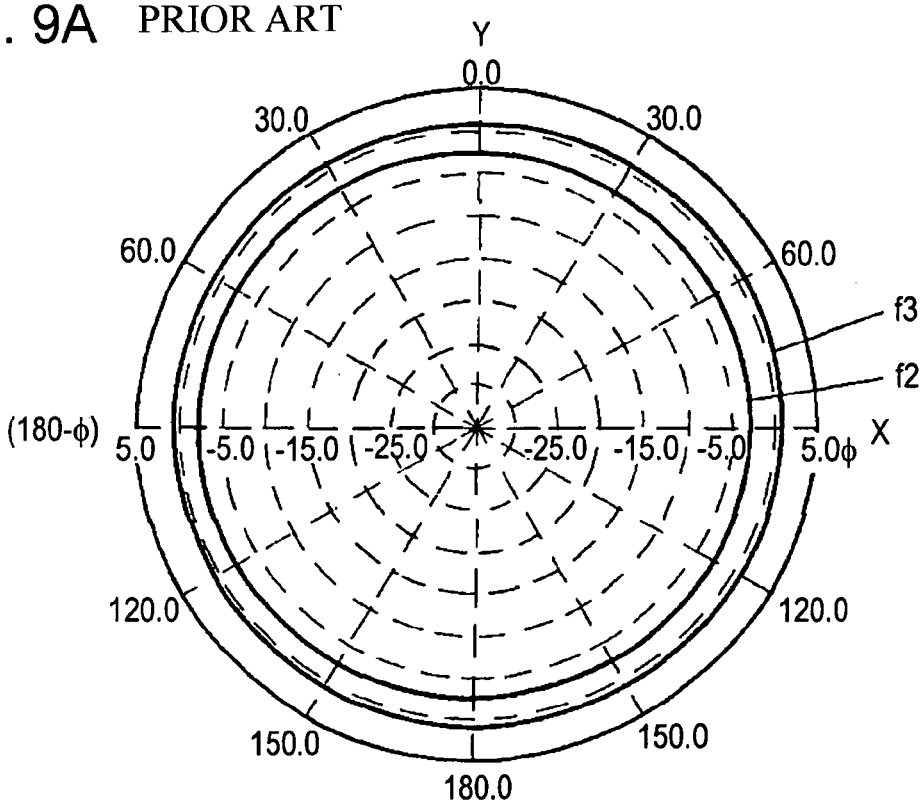
FIG. 9A PRIOR ART
FIG. 9A and FIG. 9B are characteristic diagrams of the conventional monopole antenna.
Figure 9B:
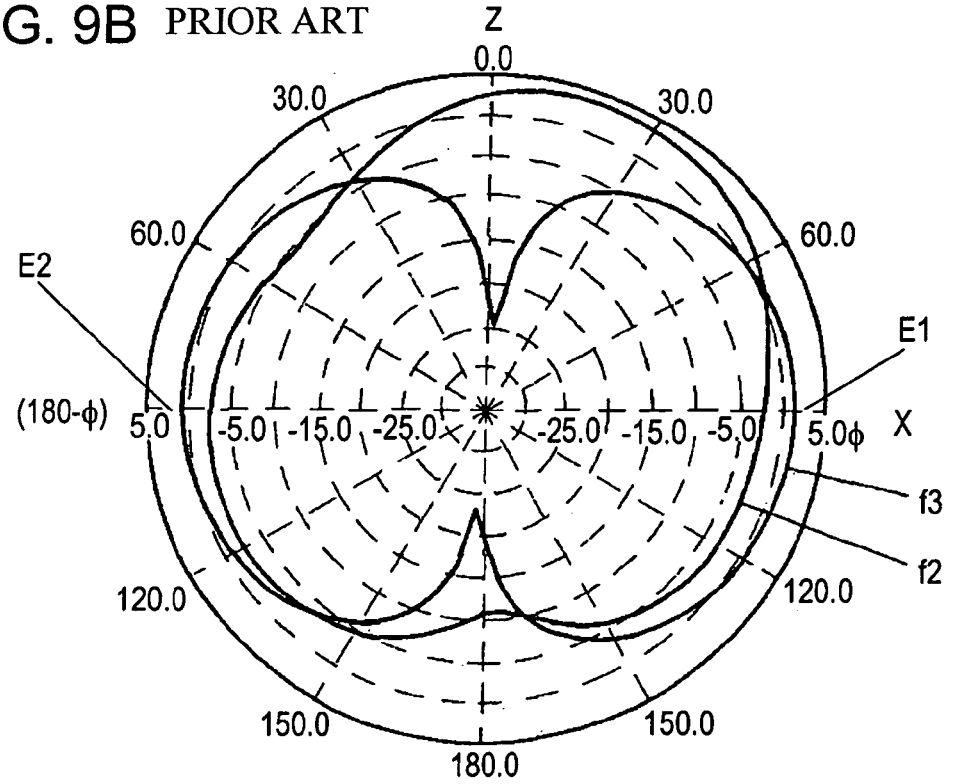
FIG. 9B PRIOR ART

As a result, the sensitivity peaks of the directivities at second frequency f2 and third frequency f3 in FIG. 2B move upward (+Z direction) above the X-axis similarly to that at second frequency f2 in the conventional antenna of FIG. 9B. Sensitivities near points E1 and E2 of FIG. 9B move inward, and the radio emission intensity becomes lower than 0 dBi.

When diameter "L" of ground plane 1 is in the range of 56 to 150 mm, namely longer than diameter "D" of second outer conductor 13 and shorter than the wavelength of highest frequency f1, the directivities are vertically symmetric about the X-axis as shown in FIG. 2B. Therefore, the radio emission intensities near points E1 and E2 of FIG. 2B can be secured to be 0 dBi or higher.

According to an experiment, preferable diameter "L" of ground plane 1 is ⅔ of wavelength "λ" defined at highest frequency f1. In the case discussed above, diameter "L" is ⅔ of wavelength "λ" of the 2 GHz band.

In the present embodiment, flat conductor 10 is formed of inner conductor 11, first outer conductor 12, and second outer conductor 13. The adjacent conductors are interconnected through a plurality of coupling conductors 311, 312, 321 and 322. Thus, monopole antenna 40 operating at three frequencies can be obtained. In other words, inner conductor 11 operates in the 2 GHz band, first outer conductor 12 operates in the 1.9 GHz band on the high frequency side for a car telephone, and second outer conductor 13 operates in the 0.9 GHz band on the low frequency side for the car telephone, for example.

When angles "θ" of coupling conductors 311, 312, 321 and 322 are appropriately selected, a desired operating frequency can be obtained.

Since the outer size of the antenna, namely set length "A1", can be set not longer than ¼ wavelength of the operating frequency, a smaller monopole antenna can be obtained.

Since inner conductor 11, first outer conductor 12, second outer conductor 13, and coupling conductors 311, 312, 321 and 322 can be integrated on the same plane in flat conductor 10, flat conductor 10 can be easily processed and monopole antenna 40 can be easily manufactured.

When short-circuit conductor 5 and linear conductor 3 are resonated in the same phase, the resonance is strengthened and, hence, the height of the antenna can be further decreased. The impedance as the monopole antenna is also increased, so that the excitation band can be increased.

Figure 5:
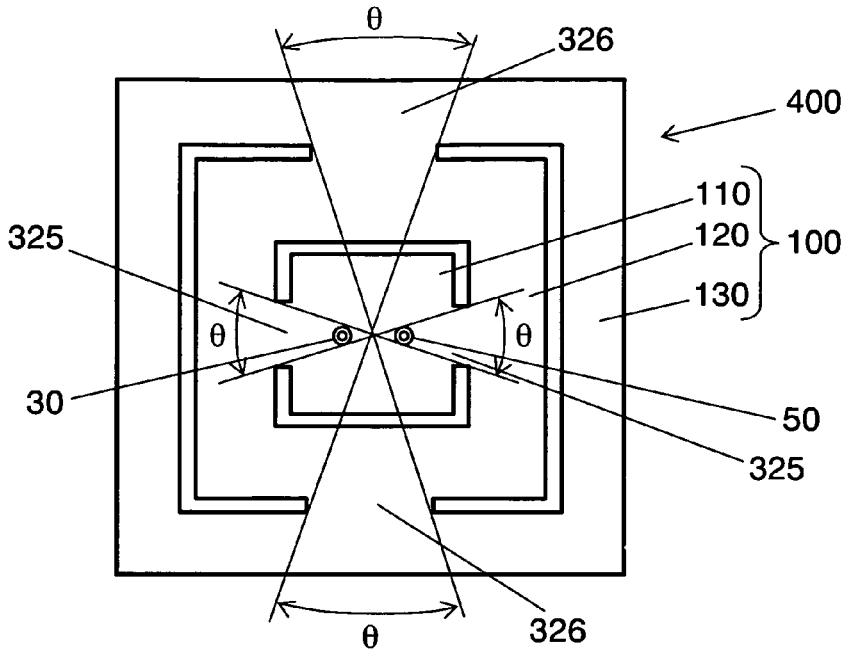
FIG. 5 is a plan view illustrating a shape of an antenna element of another monopole antenna in accordance with the exemplary embodiment.

Flat conductor 10 is circular in the present embodiment; however, the present invention is not limited to this. When flat conductor 10 has a polygonal shape such as a square as shown in FIG. 5, for example, a similar advantage can be obtained. FIG. 5 is a plan view illustrating a shape of antenna element 400 of another monopole antenna of the present embodiment. In this monopole antenna, all of inner conductor 110, first outer conductor 120, and second outer conductor 130 that configure flat conductor 100 are square. Linear conductor 30 and short-circuit conductor 50 are disposed so as to connect to inner conductor 110, and have the same configuration as those of monopole antenna 40 shown in FIG. 1.

Coupling conductor 325 for connecting inner conductor 110 to first outer conductor 120 and coupling conductor 326 for connecting first outer conductor 120 to second outer conductor 130 are disposed orthogonally to the center of flat conductor 100. Coupling conductors 325 and 326 are set to have the same angle "θ". A similar characteristic can be obtained also in the configuration of antenna element 400.

In square flat conductor 100, the using efficiency of material can be increased when a hoop-like copper sheet or a certain-shaped wiring board is used, and the cost can be therefore reduced, comparing with circular flat conductor 10 shown in FIG. 1.

Figure 6:
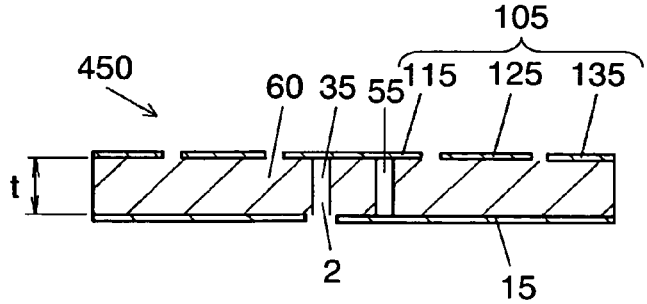
FIG. 6 is a sectional view of a configuration employing a wiring board that includes copper foil on both surfaces of a dielectric material such as phenol or epoxy having a dielectric constant larger than that of air in a still another monopole antenna in accordance with the exemplary embodiment.

The clearance between ground plane 1 and flat conductor 10 is filled with air in the present embodiment; however, the present invention is not limited to this. For example, a wiring board that includes copper foil on both surfaces of a dielectric material such as phenol or epoxy having dielectric constant larger than that of air may be used as shown in FIG. 6. FIG. 6 is a sectional view of a configuration using the wiring board that includes the copper foil on both surfaces of the dielectric material such as phenol or epoxy having dielectric constant larger than that of air in still another monopole antenna 450 in accordance with the exemplary embodiment.

In monopole antenna 450, the copper foil on one surface of dielectric substrate 60 is used as ground plane 15, and the copper foil on the other surface is used as flat conductor 105. In this case, the copper foil on the other surface is processed into a predetermined shape by a photo lithography process and an etching process, thereby forming inner conductor 115, first outer conductor 125, and second outer conductor 135. A coupling conductor for connecting inner conductor 115 to first outer conductor 125 and a coupling conductor for connecting first outer conductor 125 to second outer conductor 135 are processed simultaneously. The coupling conductors are not shown. Linear conductor 35 and short-circuit conductor 55 penetrating dielectric substrate 60 from inner conductor 115 are formed, linear conductor 35 is insulated from ground plane 15, and the insulated region is used as feeding point 2. Dielectric substrate 60 is disposed between ground plane 15 and flat conductor 105, so that distance "t" between them can be shortened as shown in FIG. 6 and the height can be reduced.

In this configuration, inner conductor 115, first outer conductor 125, second outer conductor 135, and coupling conductors can be integrated on the same plane, pattern accuracy of each conductor can be increased and dispersion in antenna characteristic can be reduced.

Figure 7A:
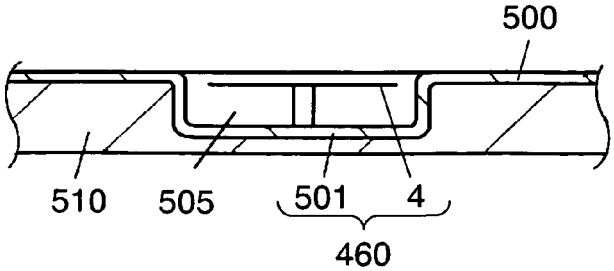
FIG. 7A is a schematic sectional view of a state where the monopole antenna of the exemplary embodiment is attached to a car body.
Figure 7B:
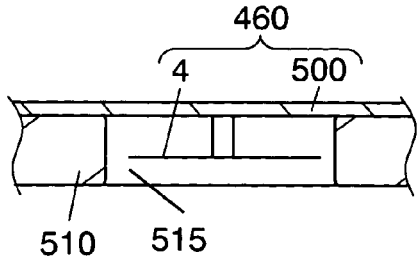
FIG. 7B is another schematic sectional view of a state where the monopole antenna of the exemplary embodiment is attached to a car body.
Figure 8:
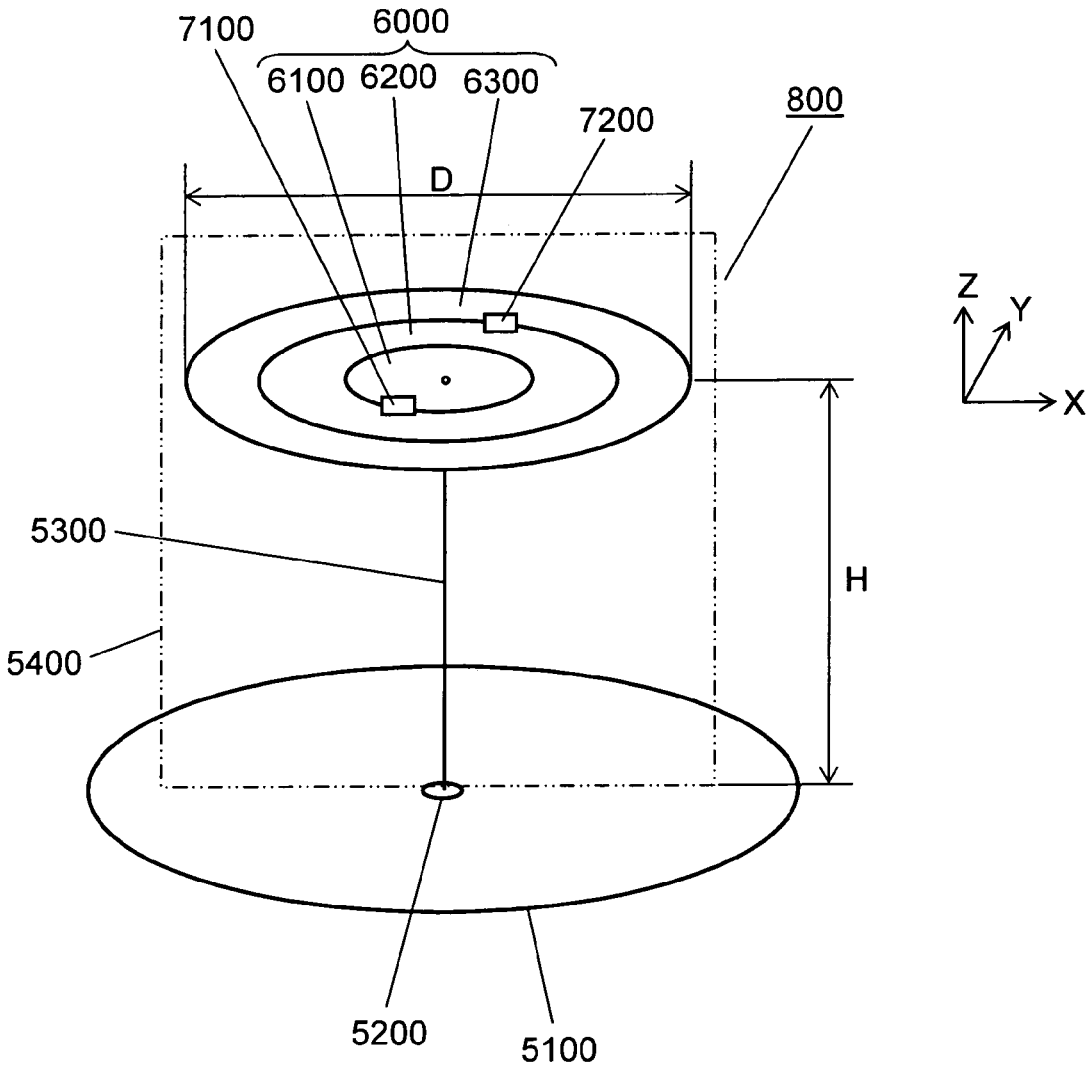
FIG. 8 PRIOR ART
FIG. 8 is a schematic perspective view of a conventional monopole antenna.

When the monopole antenna of the present invention is attached to the inside or outside of a car body, the attaching may be performed as shown in FIG. 7A and FIG. 7B. FIG. 7A is a schematic sectional view of a state where the monopole antenna of the present invention is attached to the car body. A recessed part 505 is formed in exterior chassis 500 of the car body as the ground plane, antenna element 4 is disposed in the recessed part 505, and antenna element 4 and exterior chassis 500 may configure monopole antenna 460.

Otherwise, as shown in FIG. 7B, a recessed part 515 is formed in interior cover 510 instead of exterior chassis 500, antenna element 4 is disposed in the recessed part 515, and interior cover 510 and antenna element 4 may configure monopole antenna 460.

In such a configuration, even when the monopole antenna is attached, the monopole antenna does not project from interior cover 510 or exterior chassis 500 into the cabin or out of the cabin. Therefore, a side advantage that the monopole antenna does not disturb the external design of the car body is obtained.

What is claimed is:

1. A monopole antenna comprising:

a ground plane;

a flat conductor faced to the ground plane and separated from the ground plane by a predetermined clearance, the flat conductor having an inner conductor and an outer conductor that is disposed around the inner conductor and separated from the inner conductor by another predetermined clearance;

a linear conductor coupled to the flat conductor, the linear conductor extending on a ground plane side in an insulated state from the ground plane and being coupled to a feeding point; and at least one coupling conductor at a region of the another predetermined clearance for inter-coupling an outer edge of the inner conductor and an inner edge of the outer conductor, wherein the outer conductor includes a first outer conductor disposed at an outer periphery of the inner conductor with the another predetermined clearance therebetween and a second outer conductor disposed at an outer periphery of the first outer conductor with a predetermined interval therebetween, the coupling conductor is a plurality of coupling conductors respectively disposed in between the inner conductor and the first outer conductor and in between the first outer conductor and the second outer conductor, and each of the coupling conductors coupling the inner conductor to the first outer conductor and the first outer conductor to the second outer conductor is formed with a set angle and each resonates with different set frequency.

2. The monopole antenna according to claim 1, wherein the plurality of coupling conductors are disposed at positions symmetric with respect to a center of the flat conductor.

3. The monopole antenna according to claim 1, wherein the flat conductor is formed by an integration of the inner conductor, the outer conductor, and the coupling conductor.

4. The monopole antenna according to claim 1, further comprising a short-circuit conductor disposed in parallel with the linear conductor, wherein the short-circuit conductor short circuits the ground plane and the inner conductor.

5. The monopole antenna according to claim 1, further comprising a dielectric material, wherein the ground plane is disposed on one surface of the dielectric material, a flat conductor is disposed on another surface of the dielectric material, and the linear conductor coupled to the flat conductor is extended on the ground plane side in the insulated state from the ground plane, and is coupled to the feeding point.

6. The monopole antenna according to claim 1, wherein an outer size of the ground plane is larger than an outer size of the flat conductor, and is smaller than a wavelength of a highest frequency of a plurality of operating frequencies.

* * * * *